United States Patent [19]

Green

[11] Patent Number: 4,776,133

[45] Date of Patent: Oct. 11, 1988

[54] PET DOOR

[76] Inventor: Anthony J. Green, Linton House, 39/51 Highgate Rd., London NW5 1TL, United Kingdom

[21] Appl. No.: 106,636

[22] Filed: Oct. 8, 1987

[30] Foreign Application Priority Data

Oct. 8, 1986 [GB] United Kingdom ..... 8624151

[51] Int. Cl.[4] ..... E05B 65/06; E05C 19/00

[52] U.S. Cl. ..... 49/394; 49/169

[58] Field of Search ..... 49/394, 169, 170, 171, 49/168; 160/180

[56] References Cited

U.S. PATENT DOCUMENTS

| | | | |
|---|---|---|---|
| 4,022,263 | 5/1977 | Beckett et al. | 160/92 |
| 4,043,079 | 8/1977 | Smith | 49/394 |
| 4,210,743 | 8/1980 | Cohen | 49/171 X |

FOREIGN PATENT DOCUMENTS

| | | |
|---|---|---|
| 1567001 | 5/1980 | United Kingdom . |
| 1580537 | 12/1980 | United Kingdom . |
| 2101182 | 4/1984 | United Kingdom . |
| 2142070 | 1/1985 | United Kingdom . |

*Primary Examiner*—Philip C. Kannan

*Attorney, Agent, or Firm*—Killworth, Gottman, Hagan & Schaeff

[57] ABSTRACT

A pet door comprises a hinged flap mounted within a fixed frame and pivotable to allow passage therethrough in both directions. A locking mechanism is provided comprising a slide with two projections thereon which, in different lateral positions of the slide, are aligned with corresponding projections or cut-outs on the flap to allow or prevent pivoting of the flap in one or both directions. The locking mechanism can thus be set as desired to allow free access in both directions, to allow access in one direction only (in or out as desired) or to prevent any opening of the flap.

6 Claims, 6 Drawing Sheets

PET DOOR

FIELD OF THE INVENTION

This invention relates to a door for enabling cats or other small animals to enter or leave a building while keeping the building secure against human intruders.

DESCRIPTION OF THE PRIOR ART

Cat doors generally comprise a fixed frame fitted around an opening made at the bottom of an ordinary door and a flap covering the opening and hingedly attached to the frame along or adjacent its upper edge. The cat can pass through simply by pushing against the flap to lift it. To reduce draughts, many cat doors have in addition to the fixed frame and the flap, a pivoting frame having an opening through it large enough for the animal to pass through. The pivoting frame is also attached to the fixed frame along or adjacent its upper edge so as to be pivotable about an axis close to or coincident with the pivoting axis of the flap. Because the flap has to pivot in both directions there is inevitably a slight gap between the periphery of the flap and the fixed frame. The hinged frame overlies this gap to reduce draughts.

Passing in one direction the animal passes through the hinged frame as if it were fixed (it can pivot only in one direction) lifting the flap as it goes. In the opposite direction the flap lifts the hinged frame with it so that the two move as a unit.

Cat doors have been produced having locking mechanisms to prevent the animal from passing through when it is desired to keep the animal in or out. More sophisticated doors are magnetically operated, so that they can only be opened by an animal having a matching magnetic key attached to its collar. Such systems are disclosed for example in British Pat. No. 1567001 to Dunlop et al. and U.S. Pat. No. 4,216,743 to Cohen et al.

British Patent specification Nos. 2101182 and 2142070 disclose manual locking devices incorporating a rotary knob to block movement of the door in one or both directions.

SUMMARY OF THE INVENTION

It is an object of the present invention to provide a manually lockable cat door wtth an improved and simplified locking mechanism which also helps to exclude draughts.

The present invention consists in a cat door comprising a hinged flap mounted within a fixed frame and pivotable about an axis along or adjacent one edge thereof and having a locking mechanism for the flap which is settable in any of four positions, including a first position in which the flap is free to pivot in either direction out of the plane of the frame to allow passage in either direction, a second position in which pivoting on one side of the frame is blocked to allow passage in one direction only, a third position in which pivoting on the other side of the frame is blocked to allow passage only in the opposite direction and a fourth position in which the flap is locked against pivoting in either direction.

Around the flap is a pivotable frame which can pivot in one direction only. The locking mechanism comprises a slide positioned on one edge of the frame and laterally movable between four adjacent positions corresponding to the four locking modes.

The door can thus be set for example in the first position during the day to allow a cat to come and go as it wishes. It could be set in the second position at night, to allow the cat to spend the night indoors and go out early in the morning while keeping other cats out. The third position can be used for example for trapping the cat indoors when it is due for veterinary treatment or the like. The fourth position blocks off the door entirely to keep one's own cat in and others out.

Further features and advantages of the invention will become apparent from the following detailed description when read with reference to the accompanying drawings which illustrate a preferred embodiment thereof.

DETAILED DESCRIPTION OF THE PREFERRED EMBODIMENT

Figure 1:
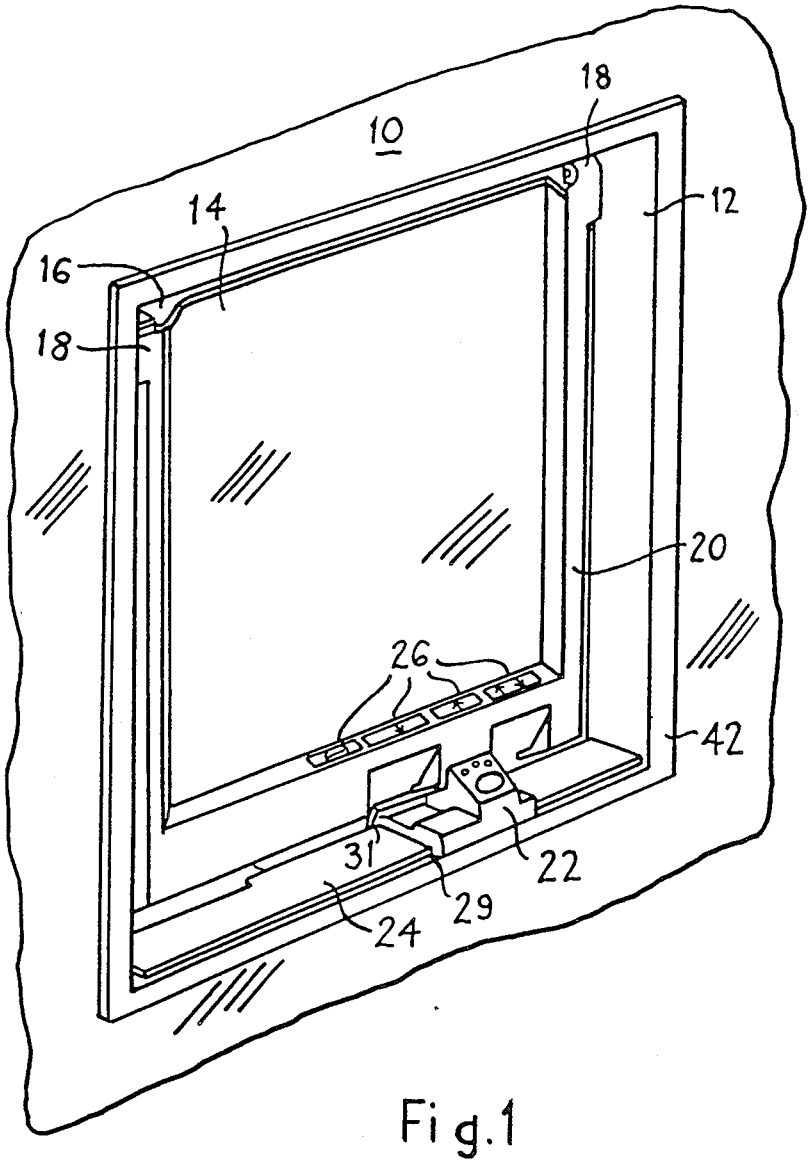
FIG. 1 is a perspective view of one side of a cat door in accordance with the invention.
Figure 10:
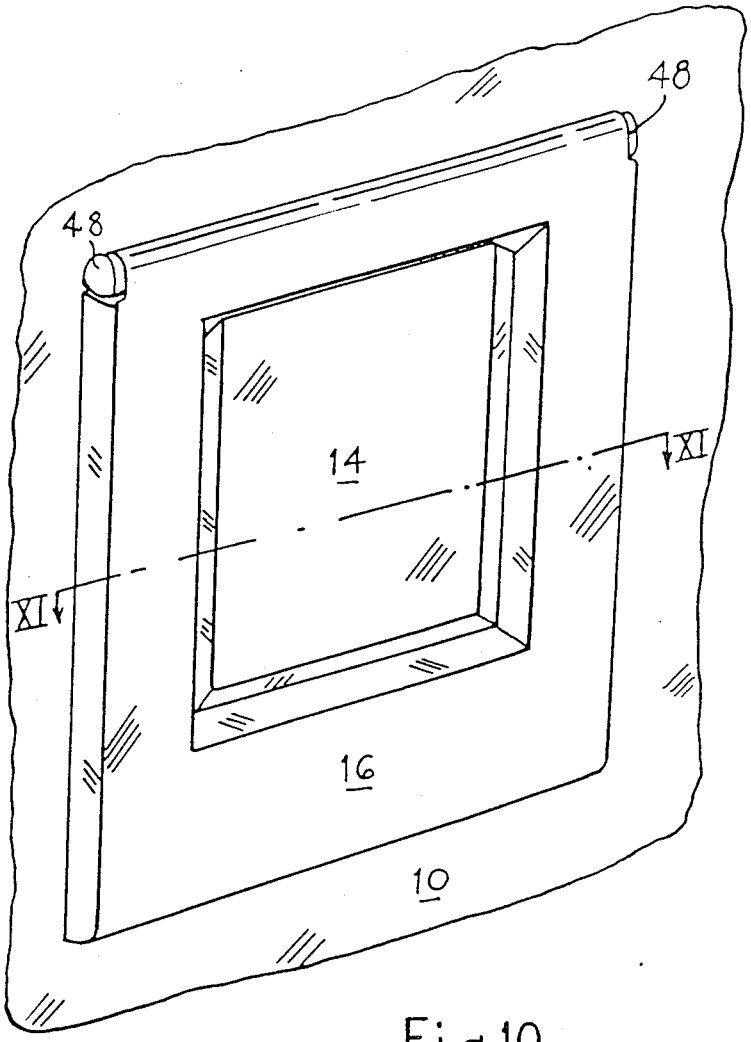
FIG. 10 is a perspective view of the other side of the cat door of FIG. 1.

Referring first to FIGS. 1 and 10, a cat door is set in a rectangular opening through an ordinary door 10 and comprises a fixed outer frame 12, a pivoting frame 16 (shown more clearly in FIG. 10) and a flap 14, the pivoting frame and the flap both being pivotally mounted on the fixed frame by adjacent pairs of hinges 18,48. These components may suitably be made from aluminium or a suitable rigid plastics material. The flap 14 may suitably be made from a transparent plastics material.

Figure 6:
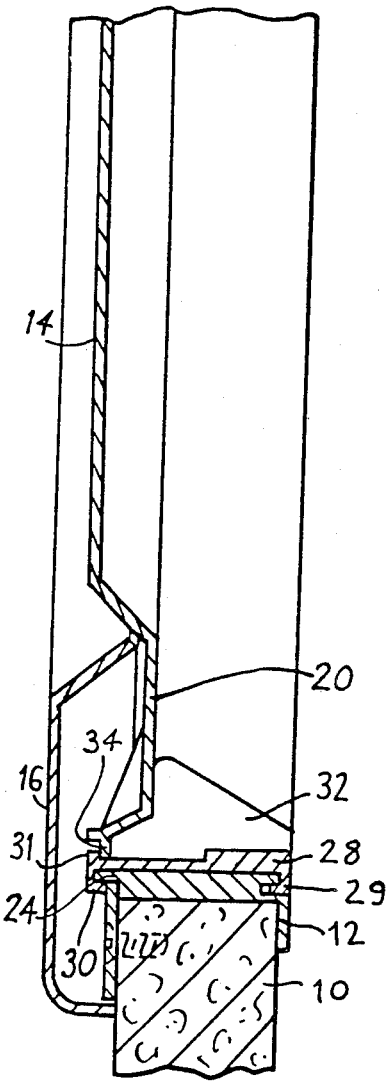
FIGS. 6 to 9 are respective cross-sectional views on the lines VI—VI, VII—VII, VIII—VIII, and IX—IX in FIGS. 2 to 5.

As can be seen in FIGS. 6 and 10, the pivoting frame is of rectangular shape with a substantially square opening which the flap 14 overlies. The pivoting frame is of channel-shaped cross section, and this interengages with a channel-shaped peripheral portion 20 of the flap 14. This interengagement helps to prevent draughts.

As can be seen in FIGS. 6 to 9 the pivoting frame 16 is free at all times to pivot away from the door 10 in one direction (to the left as shown in these Figures) but cannot pivot in the opposite direction since it is too large to pass through the fixed frame 12. The flap 14 can, when not blocked by the locking mechanism described below pivot away from the pivoting frame 16 (to the right as shown in FIGS. 6 to 9) and is also small enough to pass through the outer frame 12 and pivot with (but not through) the pivoting frame 16.

A cat or other small animal can pass through the cat door in either direction. From the side shown in FIG. 1, the cat pushes the flap 14 and pivoting frame together pivoting them upwards and away from the door 10, and passes through the outer frame 12. From the opposite side shown in FIG. 10 the cat has only to push against the flap 14 and step through the opening in the pivoting frame 16.

The cat door has a locking mechanism comprising a slider 22 mounted on a horizontal flange 24 along the bottom edge of the fixed frame 12. The slider is made from a resilient plastics material and comprises a rectangular base with a pair of longitudinal flanges 29,30 along opposite edges of its underside which engage around the edges of the flange 24 to secure the slider to it. The slider also has a flange 31 on its upper side along one edge, adjacent and parallel to flange 30, and a raised knob 32 for moving the slider, the knob being displaced towards one end of the slider.

Figure 2:
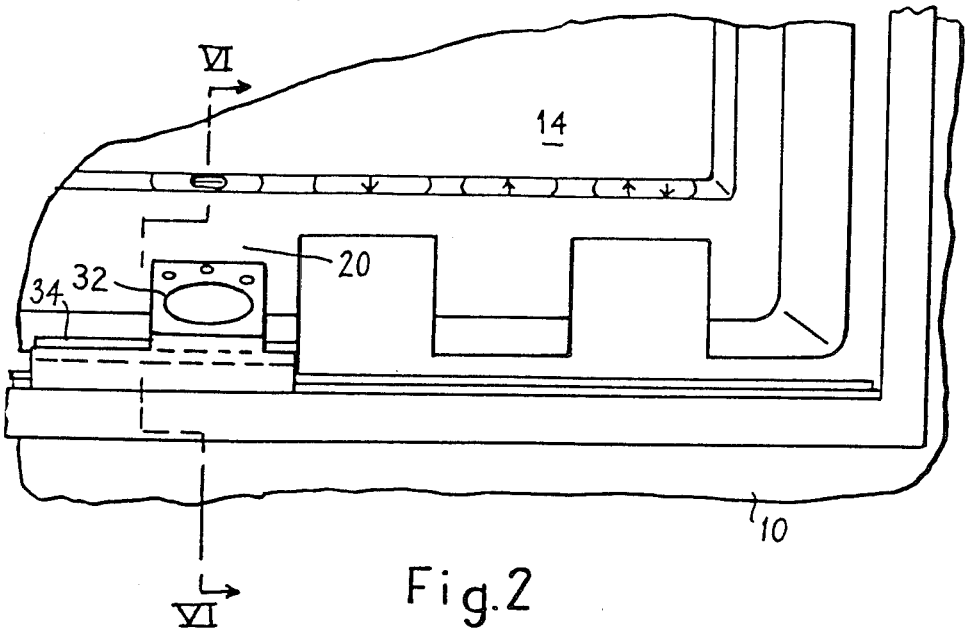
FIGS. 2 to 5 are partial front elevations of the door of FIG. 1 showing the locking mechanism in each of its four possible positions.

With the slider in the position shown in FIGS. 2 and 6, the flap 14 is locked against movement in either direction. Movement to the right as shown in FIG. 6 is blocked by the knob 32 which abuts the outer edge 20 of the flap 14, and movement in the opposite direction is prevented by engagement of the flange 31 on the slider with a flange 34 extending along part of the bottom edge of the flap. The cat door is thus locked in both directions.

Figure 3:
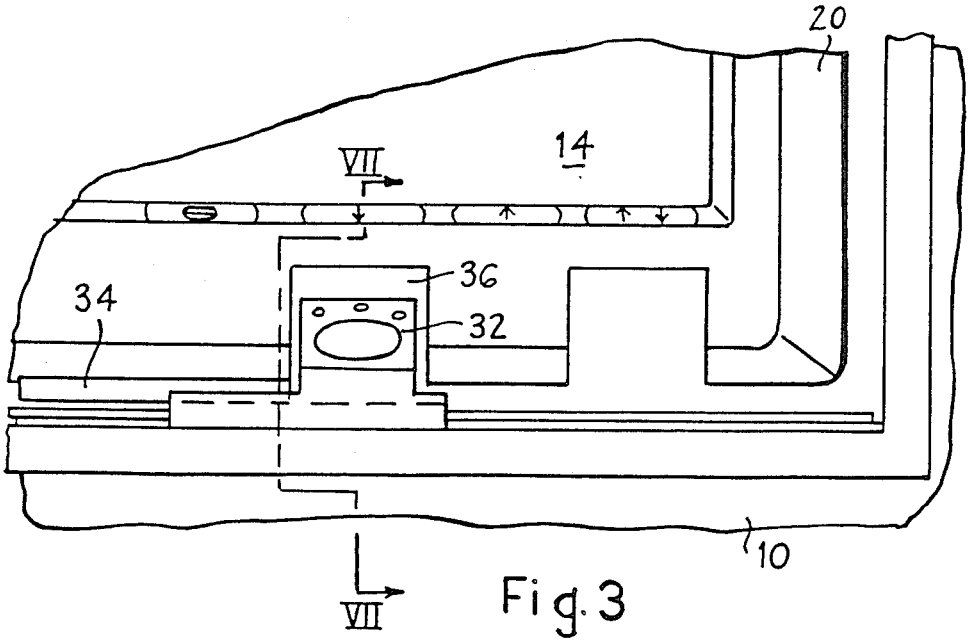
Figure 7:
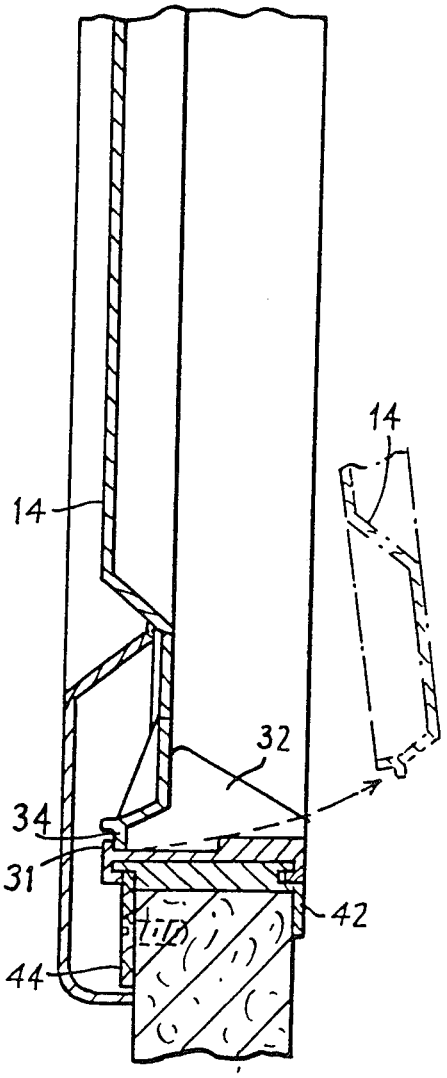

In the position shown in FIGS. 3 and 7 the knob 32 is aligned with a cutout 36 in the flap 14 so that it no longer blocks movement of the flap. The flap is thus free to pivot to the right as shown in FIG. 7. Pivoting in the opposite direction is however still prevented by interengagement of the flanges 31 and 34.

Figure 4:
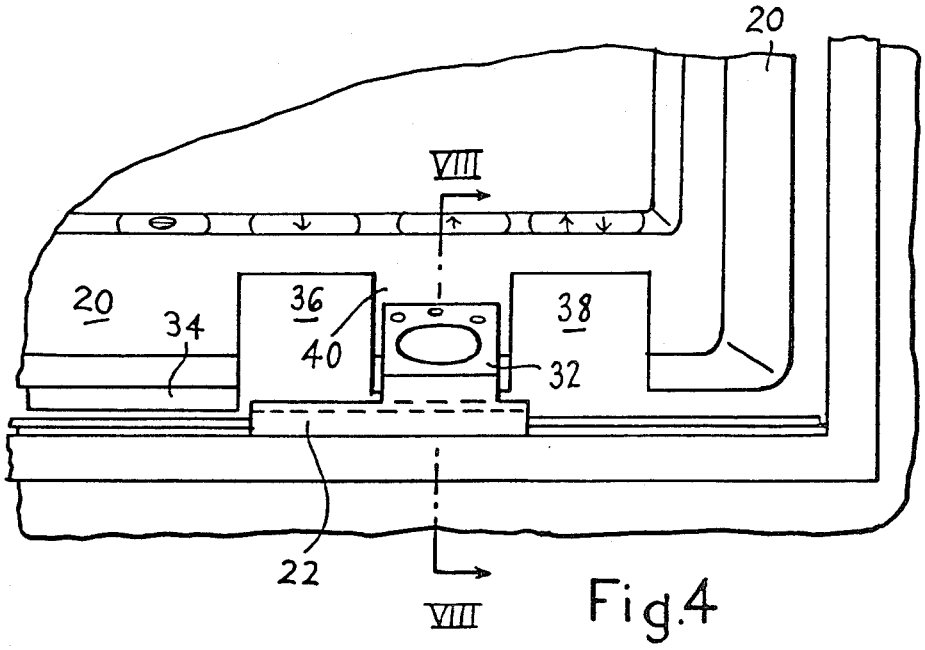
Figure 5:
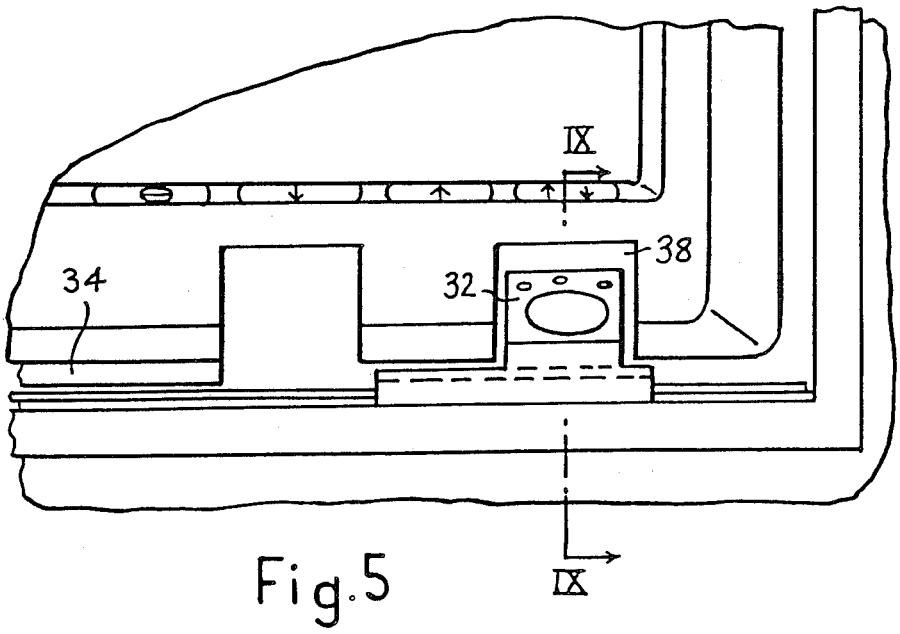
Figure 8:
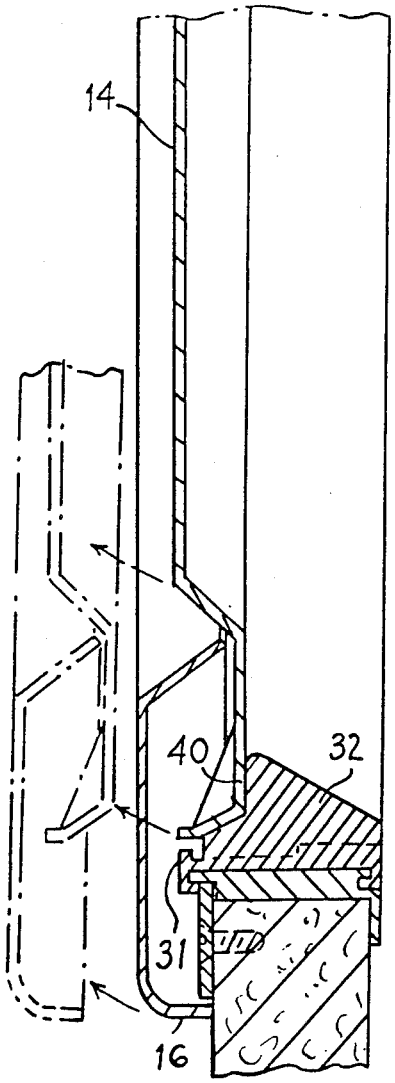
Figure 9:
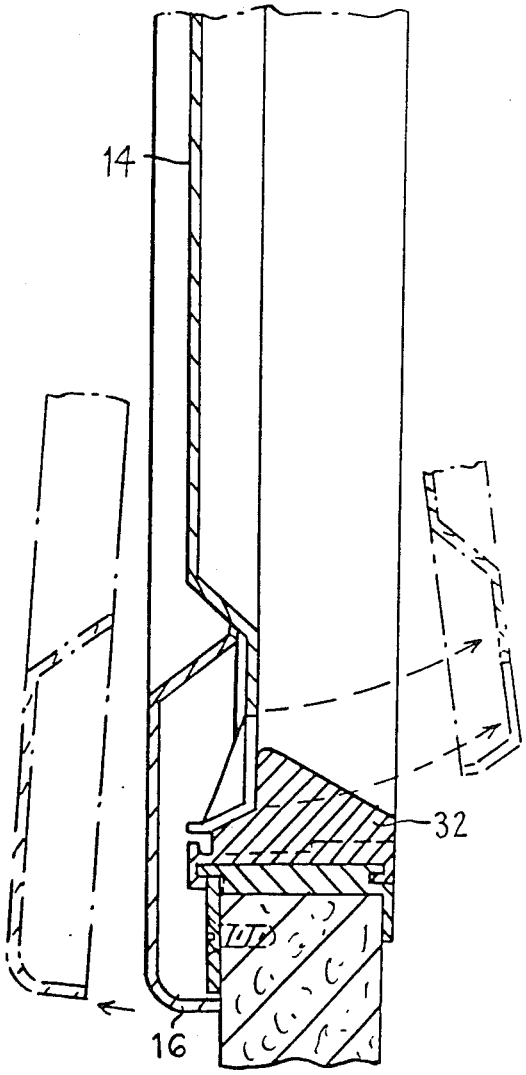

Moving the knob 32 further to the right brings it into the position shown in FIGS. 4 and 8 in which it is aligned with a part 40 of the outer edge 20 of the flap 14, blocking movement of the flap to the right as shown in FIG. 8. The flap can however move in the opposite direction, together with the pivoting frame 16, since the slider 22, with its flange 31, has been moved clear of the flange 34.

Finally, moving the slider one place further to the right brings the knob 32 into alignment with the cutout 38. It is now possible to move the flap in either direction, and an animal can pass through in either direction.

Labels 26 on a lower edge of the flap 14 indicate, for each position of the knob 32, whether passage is possible both ways, one way or neither way.

The fixed frame 12 has an outer border 42 for improved appearance on one side of the door. On the other side of the door (see for example FIG. 7) a border 44 is secured with screws or the like. This border is separate from the outer frame 12, to allow the outer frame and the border 44 to be fitted to doors of different thickness.

Figure 11:
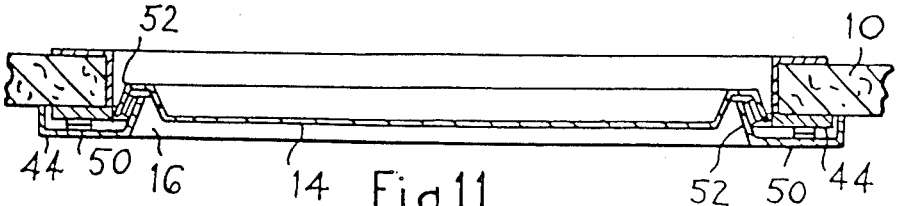
FIG. 11 is a cross section on the line XI—XI in FIG. 10.

To hold the door shut against draughts or vibrations, magnetic locks 50 are provided on each side of the fixed frame border 44 as shown in FIG. 11. Each of these comprises a magnetic strip on the fixed border and a steel strip on the pivoting frame 16, or vice-versa. Similar magnetic locks 52 are provided between the flap 14 and the pivoting frame 16, on either side of the flap 14. The magnetic locks are sufficiently strong to hold the components 14 and 16 in the closed position against draughts or the like, but not strong enough to resist pushing by an animal wanting to pass through.

What is claimed is:

1. A pet door comprising a hinged flap mounted within a fixed frame and pivotable about an axis along one edge thereof and a locking mechanism for the flap, wherein said locking mechanism comprises a sliding member arranged to slide along an edge of said fixed frame remote from said axis, said slide having a first projection on one side of the flap and a second projection on the other side of the flap, and being movable between a first position in which both of said projections are clear of the flap, enabling it to move in both directions out of the plane of the frame to allow passage in both directions, a second position in which the first projection abuts the flap in its closed position to block movement in a first direction while the second projection is clear of the flap to allow passage in a second, opposite, direction, a third position in which the first projection is again clear of the flap and the second projection engages the flap, thereby allowing passage only in said first direction and a fourth position in which the flap is retained between first and second projections against pivoting in either direction.

2. A pet door as claimed in claim 1 wherein said first projection comprises a knob which can be used for manual movement of the slide.

3. A pet door as claimed in claim 1 wherein in said first and third positions the first projection is aligned with cutouts in the flap whereby the flap can pass over the projection in said positions thereof.

4. A pet door as claimed in claim 1 wherein said second projection comprises a flange which, in said third and fourth positions, engages a corresponding flange on the edge of the flap.

5. A pet door as claimed in claim 1 further comprising a pivoting frame positioned on the same side of the flap as said second projection and pivotable with the flap in said second direction only, said pivoting frame overlying the outer edges of the flap, and having a central opening to allow passage through the flap in said first direction.

6. A pet door as claimed in claim 1 wherein said pivoting axis of the flap runs along the upper edge of the flap and the sliding member is positioned adjacent the lower edge of the flap.

* * * * *